United States Patent [19]

Hessler et al.

[11] 4,428,823

[45] Jan. 31, 1984

[54] INTEGRATED THERMAL CRACKING AND VISBREAKING PROCESS

[75] Inventors: Norman F. Hessler, Wheeling; Frank Stolfa, Park Ridge; William H. Munro, Lincolnshire, all of Ill.

[73] Assignee: UOP Inc., Des Plaines, Ill.

[21] Appl. No.: 455,355

[22] Filed: Jan. 3, 1983

[51] Int. Cl.[3] ..... C10G 51/06; C10G 65/18

[52] U.S. Cl. ..... 208/78; 208/106

[58] Field of Search ..... 208/78, 72, 76, 77, 208/106

[56] References Cited

U.S. PATENT DOCUMENTS

| | | | |
|---|---|---|---|
| 2,045,458 | 6/1936 | Gary et al. | 208/102 |
| 2,207,598 | 7/1940 | Ruthruff | 208/77 |
| 2,281,881 | 5/1942 | Keith, Jr. et al. | 208/77 |
| 2,288,262 | 6/1942 | Atwell | 208/77 |
| 2,311,357 | 2/1943 | Atwell | 208/77 |
| 2,662,845 | 12/1953 | Simpson et al. | 208/77 |
| 3,775,293 | 11/1973 | Watkins | 208/86 |
| 3,891,539 | 6/1975 | Nelson et al. | 208/59 |

OTHER PUBLICATIONS

Petroleum Processing Handbook, McGraw-Hill Book Company, 1967, pp. 3-62 thru 3-68.

Petroleum Refinery Engineering, McGraw-Hill Book Company, 1958, pp. 691-693.

Mekler et al., "Thermal Processing Trends in Western Europe" *World Petroleum*, Jun. 1966, pp. 30-38.

*Primary Examiner*—Delbert E. Gantz

*Assistant Examiner*—O. Chaudhuri

*Attorney, Agent, or Firm*—James R. Hoatson, Jr.; John F. Spears, Jr.; William H. Page, II

[57] ABSTRACT

An integrated hydrocarbon conversion process wherein two different heavy oil feed streams are thermally processed is disclosed. Preferably a vacuum gas oil is charged to a thermal cracking zone and a reduced crude fraction is charged to a visbreaking heater. The effluent of each thermal operation is separated into vapor and liquid fractions, with the vapor fractions being fed to a product fractionator. The liquid fractions each enter separate but interconnected subatmospheric pressure separation zones, one of which is a vacuum column. The bottoms of a product fractionator and distillate from the vacuum column are also charged to the thermal cracking zone.

6 Claims, 1 Drawing Figure

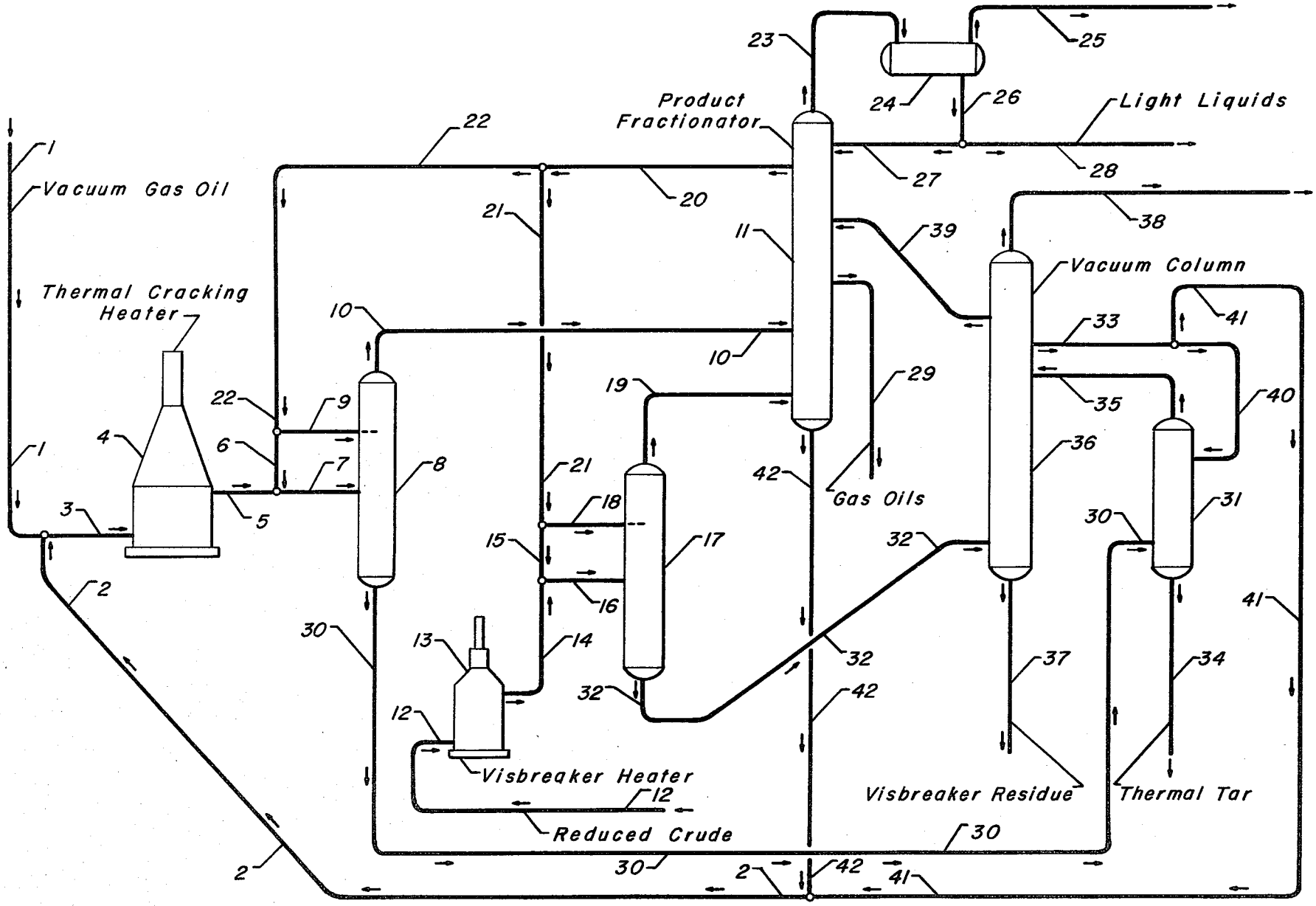
Vacuum Gas Oil
Thermal Cracking Heater
Product Fractionator
Light Liquids
Vacuum Column
Gas Oils
Visbreaker Residue
Thermal Tar
Visbreaker Heater
Reduced Crude

INTEGRATED THERMAL CRACKING AND VISBREAKING PROCESS

FIELD OF THE INVENTION

The invention relates to a hydrocarbon conversion process useful in refining petroleum. The invention more specifically relates to the thermal (noncatalytic) processing operations referred to as visbreaking and thermal cracking. The invention directly relates to an integrated process containing separate visbreaking and thermal cracking heaters and to the downstream separation steps employed to recover product streams and internal recycle streams in such an integrated process.

PRIOR ART

The petroleum refining processes referred to as visbreaking and thermal cracking are well established commercial processes. The use of these processes has declined considerably due to the rapid development of catalytic processes, but they are still in use and new units are being designed and built. Those skilled in petroleum refining by thermal processing are therefore familiar with these processes. A brief description of various types of thermal processing operations is provided at page 3-62 of the *Petroleum Processing Handbook,* McGraw-Hill Book Co., 1967.

It is also known in the art that various thermal processes may be integrated through the use of common product separation facilities. Such processes are described at pages 691–693 of the 4th edition of *Petroleum Refinery Engineering* by W. L. Nelson, McGraw-Hill Book Co., 1958. Another such integrated process is shown in FIG. V of U.S. Pat. No. 2,662,845 issued to W. C. Simpson et al. This process employs both atmospheric and vacuum distillation and recycles a heavy gas oil to the thermal cracking heater.

A variety of processes employing two thermal processing units are shown in an article at page 30 of the June, 1966, edition of *World Petroleum.* The process shown in FIG. 3 utilizes visbreaking of a crude oil atmospheric residue and thermal cracking of a vacuum gas oil, with atmospheric and vacuum columns used for fractionation. A gas oil stream is recycled to the thermal cracking heater. Another process employing thermal cracking and visbreaking is illustrated in U.S. Pat. No. 2,045,458. In this reference the effluent of both heaters is fed to a common separation zone, with the separation zone vapor stream entering a superatmospheric pressure fractionator and the separation zone liquid stream being charged to an atmospheric flash tower.

BRIEF SUMMARY OF THE INVENTION

The invention provides a very flexible process for simultaneously thermal processing both a vacuum gas oil and a reduced crude and which yields a full slate of products including naphtha, gas oils and both thermal and visbreaker residues or tars. One embodiment of the invention may be characterized as a petroleum refining process which comprises the steps of passing a first feed stream comprising a gas oil and a hereinafter characterized first process stream through a thermal cracking zone, and passing a resultant thermal cracking zone effluent stream into a first separation zone; passing a second feed stream comprising a reduced crude through a visbreaking heater, and passing a resultant visbreaker heater effluent stream into a second separation zone; passing a first vapor stream removed from an upper portion of the first separation zone and a second overhead vapor stream removed from the upper portion of the second separation zone into a lower portion of a product fractionation column; passing a first liquid stream removed from the bottom of the first separation zone into a vacuum flash zone, with a first vapor stream being withdrawn from the top of the vacuum flash zone and being passed into a vacuum column at an intermediate point; passing a second liquid stream removed from the bottom of the second separation zone into a lower portion of the vacuum fractionation column; passing a first portion of a liquid phase lower sidecut stream removed from the vacuum column into the vacuum flash zone and combining a second portion of the lower sidecut stream with at least a portion of the net bottoms stream of the product fractionation column to produce said first process stream; passing at least a portion of a liquid phase upper sidecut stream removed from the vacuum column into the product fractionation column; and recovering a sidecut gas oil product stream and an overhead product stream from the product fractionation zone.

DESCRIPTION OF THE DRAWING

The Drawing is a simplified process flow diagram of the preferred embodiment of the invention. The Drawing has been simplified by the deletion of many accessories normally utilized on a process such as this including a multitude of indirect heat exchange means, pressure control systems, temperature control systems, flow control valves, reboiling and overhead systems of fractionation columns and various vessel internals. This presentation of the preferred embodiment of the invention is not intended to preclude from the scope of the subject invention those other embodiments set out herein or which are the result of the normal and expected modifications of those embodiments.

Referring now to the drawing, a first feed stream comprising a vacuum gas oil enters the process through line 1 and is combined with an internal process stream from line 2 before being passed into the thermal cracking heater 4 through line 3. The high temperature thermal cracking heater effluent stream carried by line 5 is passed through a reaction chamber not shown and is then admixed with a hydrocarbon liquid stream from line 6 and passed into a first separation zone 8 through line 7. An additional quantity of hydrocarbon liquid from line 9 is sprayed into an upper portion of the first separation zone. The vapor phase stream emanating from the top of the first separation zone is passed into a lower portion of a product fractionator 11 through line 10. In a similar manner, a second feed stream comprising a reduced crude is passed into a visbreaker heater 13 through line 12. The high temperature effluent of the visbreaker heater carried by line 14 is admixed with quench hydrocarbon from line 15 and the resultant admixture is passed through line 16 into a second separation zone 17. Hydrocarbon liquid is preferably also passed into an upper portion of this separation zone through line 18. The vapor stream leaving the top of the second separation zone is also passed into a bottom portion of the product fractionator 11 through line 19.

The hydrocarbon streams entering the product fractionator 11 are separated into a number of streams including the net bottoms stream removed through line 42. One or more gas oil sidecut streams, such as the product stream removed through line 29, and an overhead vapor stream removed in line 23 are withdrawn from the product fractionator. The overhead vapor stream is passed through an overhead condenser not shown, with the resultant mixed phase stream entering the overhead receiver 24 and being divided into a vapor phase stream removed in line 25 and a liquid phase stream being transported in line 26. The liquid phase material of line 26 is divided into a first portion returned to the product fractionator as reflux through line 27 and a second portion removed from the process as a light liquid naphtha stream carried by line 28. The hydrocarbon streams of lines 25 and 28 may be passed into a gas concentration unit. Also removed from the product fractionator is an upper sidecut stream which is utilized in the separation zones of the present process. This stream is removed through line 20 and divided into the two portions flowing through lines 21 and 22 to the respective separation zones.

The liquid phase hydrocarbon stream withdrawn from the first separation zone through line 30 is passed into an intermediate point of a vacuum flash chamber 31. Also passed into the vacuum flash chamber is a portion of a liquid phase lower sidecut stream removed from the vacuum column 36 by line 33 and carried by line 40. The hydrocarbons entering the vacuum flash chamber are separated into a net bottoms product stream comprising a thermal tar removed from the process in line 34 and an overhead vapor stream which is passed into the vacuum column through line 35. The liquid phase hydrocarbon stream which is withdrawn from the bottom of the second separation zone 17 is passed through line 32 into a lower portion of the vacuum column 36. The heaviest or least volatile hydrocarbons entering the vacuum column are concentrated into a net vacuum column bottoms product stream or visbreaker residue removed from the process through line 37. The liquid phase lower sidecut stream removed from the vacuum column through line 33 is divided into the portion fed to the vacuum flash chamber and a second portion carried by line 41 which is admixed with a net bottoms stream of the product fractionator to thereby form the internal process stream carried by line 2. An upper liquid phase sidecut stream is removed from an upper portion of the vacuum column 36 through line 39 and preferably passed into an upper portion of the product fractionation column 11 at a point above the gas oil drawoff. A vapor phase stream comprising light hydrocarbons is removed from the top of the vacuum column through line 38 as part of a vapor stream which enters the means utilized to maintain the subatmospheric pressure within the vacuum column.

DETAILED DESCRIPTION

One of the current trends in petroleum refining is the increased use of the well established thermal processing operations of visbreaking and thermal cracking. These old and well established processes have been found to be economically attractive in the revamping of existing refineries and in new refineries. To a large extent, thermal processing is being considered as a method of not only producing high value products, such as diesel fuel, heating oil and naphtha, from residual oils but also as a method of increasing the processability of these heavy oils such as vacuum gas oils or reduced crudes. One significant function of the new thermal cracking process units is to convert some portion of the residual materials into a lighter material which is more suitable for processing in conventional refining operations including fluidized catalytic cracking units.

It is an objective of the subject invention to provide a hydrocarbon conversion process for simultaneously thermally processing a vacuum gas oil feed stream and a reduced crude feed stream. It is a further objective of the subject invention to provide a flexible process for thermally treating residual hydrocarbons which produces gas oils suitable for further upgrading and also produces separate visbreaking and thermal cracking residues.

The thermal processing or thermal decomposition of petroleum streams is divided into several areas on the basis of processing conditions and charge stocks. Although there is some overlap in both conditions and charge stocks, the various thermal processes are normally characterized as either visbreaking, thermal cracking, thermal reforming or coking. When a gas oil or a reduced (topped) crude is processed mainly for the production of lighter materials such as gasoline and/or distillates, the process is called thermal cracking. If the charge stock is a residual material which is processed mildly in a once through operation to reduce its viscosity and/or to produce gas oils, the process is called visbreaking. Thermal reforming causes a great deal of cracking and is characterized by higher operating temperatures and naphtha boiling range charge stocks. Coking involves the intentional conversion of charge materials to solids and involves long retention times within the coke chamber.

Processing conditions for visbreaking include a temperature within the general range of about 800° to about 975° F., with temperatures above 900° F. being preferred. Visbreaking conditions also comprise a pressure between about 25 and 300 psig. The charge stock is preferably subjected to these visbreaking conditions for a period of about 20 to 65 equivalent seconds at 900° F. within the visbreaking heater zone. The effluent of the visbreaker heater is then preferably quenched, as with a light gas oil, to reduce its temperature by about 30 to 140 degrees. A common variation in visbreaking is the use of a "soaker drum" in which the still hot effluent of the visbreaker heater is retained for a preselected time. In these soaker type visbreakers the thermal conversion reactions continue within the drum thereby allowing a reduction in the temperature required for the same degree of conversion. Further information on visbreaking may be obtained from many sources including the previously cited references and such articles as those appearing at page 109 of the Apr. 13, 1981, issue of *The Oil and Gas Journal* and at page 81 of the May 1981 issue of *Hydrocarbon Processing.*

Many of the previously cited references also describe thermal cracking operations and conditions. Since the processing conditions overlap, the distinction between visbreaking and thermal cracking is normally based primarily on the charge stock and the objective of the process. A general range of thermal cracking conditions includes a heating coil outlet temperature between about 800° and 975° F. and a pressure of about 50 to about 700 psig. It is a common practice in thermal cracking units to recycle a portion of the available gas oil fractions such that the recycle to feed ratio may be from 1.1:1 to 5:1. This allows the achievement of the desired total amount of conversion with a lower percentage of cracking per pass and hence milder operating conditions. The recycling also allows the dilution of olefinic products and reduces polymerization and coking within the heating coils. Thermal cracking processes are also described in such readily available references as U.S. Pat. Nos. 3,549,519 and 4,201,659.

The operation of the subject process is illustrated by the following example, which is based on the projected (design) operation of a commercial scale unit having a flow similar to that shown in the drawing. The first feed stream is a vacuum gas oil stream having a flow rate of about 2,770 BPSD (barrels per stream day) and an average molecular weight of approximately 395. This feed stream is admixed with the net bottoms stream of the product fractionation column, which has a flow rate of about 8,595 BPSD and an average molecular weight near 295, and with a larger stream of visbreaker heavier material drawn off the vacuum column. This stream has a flow rate of about 18,010 BPSD and an average molecular weight of approximately 382. The admixture of these three streams is charged to the visbreaker heater coils having an operating pressure of 250 psig and an outlet temperature of about 910° F.

The effluent of a thermal cracking reaction chamber is admixed with a quench stream having a temperature of approximately 400° F. and passed into a flash chamber having a pressure near 50 psig and which serves as the first separation zone. An additional portion of this same material is sprayed into the flash chamber above the feed point. A vapor stream having an average molecular weight of about 144 and a flow rate of about 2,290 moles per hour is removed from the flash chamber at a temperature of about 780° F. and passed into the product fractionator. The liquid stream removed from the bottom of this first separation zone has an average molecular weight of about 308 and a flow rate of about 10,440 BPSD. This liquid stream is passed into the vacuum flash zone. The materials entering this vacuum flash zone are divided into a vapor stream having a temperature near 600° F. and a flow rate of about 341 moles per hour and a net bottoms stream of thermal tar having a flow rate of about 4,925 BPSD.

The second feed stream comprises a reduced crude having an average molecular weight of 500 and a flow rate of about 42,540 BPSD. This feedstream is passed through a visbreaking heater having an operating temperature of approximately 925° F. and a pressure near 50 psig. The visbreaker heater effluent is admixed with a stream of the same 400° F. quench material and then passed into a second flash chamber, which is referred to herein as the second separation zone. A vapor stream having an average molecular weight of about 147 and a flow rate of approximately 2,320 moles per hour is removed from the second flash chamber and passed into the product fractionator. The net liquid stream removed from the second flash chamber is passed into a vacuum fractionation column at the rate of approximately 35,100 BPSD and has an average molecular weight of about 416.

Besides the vapor streams withdrawn from the first and second flash chambers a liquid stream removed near the top of the vacuum column is passed into the product fractionator. The compounds in these three input streams are separated into a number of streams withdrawn from the product fractionator including the previously described net bottoms which is recycled to the thermal cracking heater. Also withdrawn is a heavy gas oil sidecut stream having an average molecular weight of approximately 244 and a flow rate near 13,035 BPSD and a light gas oil stream having an average molecular weight of about 154 and a flow rate of about 4,825 BPSD. Both of these streams are preferably withdrawn via sidecut strippers and extensive heat exchange used to recover their useful heat. The quench and separation zone streams are drawn off the pumparound loop feeding the light gas oil sidecut stripper. An overhead vapor stream is removed from the product fractionator and passed through an overhead condenser which cools this stream to about 100° F. at a pressure of approximately 35 psig. The uncondensed vapors are passed to a gas concentration unit at the rate of about 880 moles per hour. The condensate is separated into a reflux stream and a net liquid stream having an average molecular weight of about 89 and a flow rate of approximately 4,300 BPSD. The gas oils and overhead streams are valuable products of the process.

The net liquid stream removed from the second flash chamber is passed into a vacuum column. A net bottoms liquid stream comprising the visbreaker residuum having a flow rate of about 16,885 BPSD is derived from the bottoms liquid of the vacuum column. A heavy vacuum gas oil pumparound loop withdrawn from a midpoint of the vacuum column is the source of an approximately 18,010 BPSD stream which is passed into the thermal cracking heater and an additional stream of about 1,310 BPSD which is passed into the top portion of the vacuum flash zone. This material has an average molecular weight of about 382. Also fed into the vacuum flash zone is the net bottoms of the first separation zone. These two input streams are separated into a liquid stream, referred to as thermal tar, having a flow rate of about 4,940 BPSD. A vapor stream having an average molecular weight of about 283 and a flow rate of approximately 341 moles per hour is removed from the top of the vacuum flash zone and passed into the vacuum column. A light vacuum gas oil is withdrawn off a pumparound stream as the top product of the vacuum column and passed into the product fractionator at the rate of about 5,580 BPSD.

Those skilled in the art will appreciate the large number of potential variations in performing the process just described. For instance, there are numerous ways in which the heat exchangers, pumparound loops and other equipment used to perform the subject process may be arranged. The structure of the separation zones and the fractionation zones is also an area in which the mechanical design of the equipment will be subject to much variation. The separation zones preferably do not contain trays or packing, while the product fractionator is preferably a trayed column having 30 to 40 trays and the vacuum column contains zones of packing common to such columns. The vacuum flash zone is preferably an untrayed flash chamber having a mesh bed below the gas oil feed point. A trayed separation zone may also be employed as the vacuum flash zone.

Another area in which much variation is possible is the operating conditions employed in the process. The pressure, temperature and operating ratios of both the product fractionator and vacuum column may be varied without departing from the inventive concept. It is preferred that the product fractionator is operated at a superatmospheric pressure between about 10 and about 150 psig and that the vacuum column is operated at a pressure, as measured at the top of the column, of less than 100 mm Hg abs.

We claim as our invention:

1. A petroleum refining process which comprises the steps of:

(a) passing a first feed stream comprising a gas oil and a hereinafter characterized first process stream through a thermal cracking zone, and passing a resultant thermal cracking zone effluent stream into a first separation zone;

(b) passing a second feed stream comprising a reduced crude through a visbreaking heater, and passing a resultant visbreaker heater effluent stream into a second separation zone;

(c) passing a first vapor stream removed from an upper portion of the first separation zone and a second vapor stream removed from an upper portion of the second separation zone into a lower portion of a product fractionation column;

(d) passing a first liquid stream removed from the bottom of the first separation zone into a vacuum flash zone, with a third vapor stream being withdrawn from the top of the vacuum flash zone and being passed into a vacuum fractionation column at an intermediate point;

(e) passing a second liquid stream removed from the bottom of the second separation zone into a lower portion of the vacuum fractionation column;

(f) passing a first portion of a liquid phase lower sidecut stream removed from the vacuum column into the vacuum flash zone and combining a second portion of the lower sidecut stream with at least a portion of the net bottoms stream of the product fractionation column to produce said first process stream;

(g) passing at least a portion of a liquid phase upper sidecut stream removed from the vacuum column into the product fractionation column; and, (h) recovering a sidecut gas oil product stream and an overhead product stream from the product fractionation zone.

2. The process of claim 1 further characterized in that a liquid phase upper sidecut stream is removed from the product fractionation column and is divided into at least a first portion which is admixed with the thermal cracking zone effluent stream and a second portion which is admixed with the visbreaker heater effluent stream.

3. The process of claim 1 further characterized in that a first net bottoms product is removed from the vacuum column and a second net bottoms product is removed from the vacuum flash zone.

4. The process of claim 3 further characterized in that the entire net bottoms stream of the product fractionation column is present in said first process stream.

5. The process of claim 4 further characterized in that none of the first net bottoms stream, removed from the vacuum column, is recycled within the process.

6. The process of claim 5 further characterized in that none of the second net bottoms stream, removed from the vacuum flash zone, is recycled within the process.

* * * * *